US010233793B2

(12) United States Patent
Shimada et al.

(10) Patent No.: US 10,233,793 B2
(45) Date of Patent: Mar. 19, 2019

(54) VALVE SEAT OF SINTERED IRON-BASED ALLOY

(71) Applicant: KABUSHIKI KAISHA RIKEN, Tokyo (JP)

(72) Inventors: Akiko Shimada, Kumagaya (JP); Hiroji Henmi, Kumagaya (JP)

(73) Assignee: KABUSHIKI KAISHA RIKEN, Tokyo (JP)

( * ) Notice: Subject to any disclaimer, the term of this patent is extended or adjusted under 35 U.S.C. 154(b) by 141 days.

(21) Appl. No.: 15/126,683

(22) PCT Filed: Feb. 10, 2015

(86) PCT No.: PCT/JP2015/053610
§ 371 (c)(1),
(2) Date: Sep. 16, 2016

(87) PCT Pub. No.: WO2015/141331
PCT Pub. Date: Sep. 24, 2015

(65) Prior Publication Data

US 2017/0089228 A1 Mar. 30, 2017

(30) Foreign Application Priority Data

Mar. 19, 2014 (JP) ..... 2014-055986

(51) Int. Cl.
*F01L 3/02* (2006.01)
*C22C 38/42* (2006.01)
(Continued)

(52) U.S. Cl.
CPC ..... *F01L 3/02* (2013.01); *B22F 3/12* (2013.01); *B22F 5/008* (2013.01); *B22F 7/008* (2013.01);
(Continued)

(58) Field of Classification Search
CPC ..... F01L 3/02; F01L 2103/00; F01L 2101/00; B22F 3/12; B22F 7/008; B22F 5/008;
(Continued)

(56) References Cited

U.S. PATENT DOCUMENTS 4,546,737 A * 10/1985 Kazuoka ..... B22F 7/06 123/188.8
6,082,317 A 7/2000 Takahashi et al.
(Continued)

FOREIGN PATENT DOCUMENTS

JP 63-297542 A 12/1988
JP 6-200354 A 7/1994
(Continued)

OTHER PUBLICATIONS

International Search Report issued in PCT/JP2015/053610, dated Apr. 7, 2015.
(Continued)

*Primary Examiner* — Craig J Price
*Assistant Examiner* — Andrew J Rost
(74) *Attorney, Agent, or Firm* — Birch, Stewart, Kolasch & Birch, LLP

(57) ABSTRACT

The present invention provides a valve seat of a Co-free, sintered iron-based alloy having excellent heat resistance, oxidation resistance and wear resistance, as well as excellent machinability, which is usable for internal combustion engines using a gas fuel. The valve seat is produced by using a prealloy containing 12% or more by mass of Cr in a matrix for, and hard particles having high strength and hardness at high temperatures are used, such that the entire valve seat has a composition comprising by mass 5.0-20.0% of Cr, 0.4-2.0% of Si, 2.0-6.0% of Ni, 5.0-25.0% of Mo, 0.1-5.0% of W, 0.5-5.0% of V, 1.0% or less of Nb, and 0.5-1.5% of C, the balance being Fe and inevitable impurities.

10 Claims, 2 Drawing Sheets

(51) Int. Cl.

| | |
|---|---|
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/60*** | (2006.01) |
| ***C22C 32/00*** | (2006.01) |
| ***C22C 33/02*** | (2006.01) |
| ***B22F 3/12*** | (2006.01) |
| ***B22F 5/00*** | (2006.01) |
| ***B22F 7/00*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C22C 32/00* (2013.01); *C22C 33/0285* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C22C 38/48* (2013.01); *C22C 38/52* (2013.01); *C22C 38/60* (2013.01); *B22F 2301/35* (2013.01); *B22F 2302/45* (2013.01); *B22F 2998/10* (2013.01); *F01L 2101/00* (2013.01); *F01L 2103/00* (2013.01)

(58) Field of Classification Search
CPC ..... B22F 2301/35; B22F 2998/10; B22F 2302/45; C22C 38/002; C22C 38/02; C22C 38/04; C22C 38/44; C22C 38/46; C22C 38/48; C22C 38/42; C22C 38/52; C22C 38/60; C22C 32/00; C22C 33/0285; F16K 25/005
USPC ..... 251/368; 123/41.41, 188.8
See application file for complete search history.

(56) References Cited

U.S. PATENT DOCUMENTS

| | | | | |
|---|---|---|---|---|
| 6,305,666 | B1 * | 10/2001 | Sakai | C22C 33/0228 251/368 |
| 6,702,905 | B1 * | 3/2004 | Qiao | C21D 6/002 148/326 |
| 7,241,327 | B2 | 7/2007 | Henmi et al. | |
| 8,844,903 | B2 | 9/2014 | Takahashi et al. | |
| 9,359,921 | B2 | 6/2016 | Hashimoto et al. | |
| 2002/0084004 | A1 * | 7/2002 | Takahashi | C22C 33/0207 148/320 |
| 2005/0252338 | A1 | 11/2005 | Henmi et al. | |
| 2012/0043490 | A1 * | 2/2012 | Kelsey | F16K 1/42 251/359 |
| 2012/0319026 | A1 | 12/2012 | Takahashi et al. | |
| 2015/0152753 | A1 | 6/2015 | Hashimoto et al. | |

FOREIGN PATENT DOCUMENTS

| | | | |
|---|---|---|---|
| JP | 11-12697 | A | 1/1999 |
| JP | 2002-285293 | A | 10/2002 |
| JP | 2006-299404 | A | 11/2006 |
| JP | 4299042 | B2 | 7/2009 |
| JP | 4368245 | B2 | 11/2009 |
| JP | 2011-174112 | A | 9/2011 |
| WO | WO 2014/007278 | A1 | 1/2014 |

OTHER PUBLICATIONS

Written Opinion of the International Searching Authority issued in PCT/JP2015/053610 (PCT/ISA/237), dated Apr. 7, 2015.

* cited by examiner

VALVE SEAT OF SINTERED IRON-BASED ALLOY

FIELD OF THE INVENTION

The present invention relates to a valve seat, particularly to a valve seat of a sintered iron-based alloy suitable for high-thermal-load engines such as gas engines using CNG or LPG, high-power diesel engines, etc.

BACKGROUND OF THE INVENTION

Because valve seats used in internal combustion engines are exposed to a combustion gas at high temperatures and high pressure, and repeatedly undergo high shock and sliding by the vertical and rotational motions of valves, heat resistance and wear resistance are generally needed. Further, because of recent trend of lower fuel consumption, lower emission and higher power of internal combustion engines such as automobile engines, etc., combustion has become more controlled. Particularly, the use of a clean fuel such as CNG, LPG, etc. for reducing environmental load results in a higher combustion temperature, giving an increased thermal and mechanical load to valve seats. In addition, because combustion occurs in a higher-oxygen-concentration atmosphere than ever in a lean-burn combustion technology developed to improve fuel efficiency, valve seats are required to have larger heat resistance and high-temperature strength, as well as higher oxidation resistance.

Conventional valve seats used in internal combustion engines using a gas fuel are exposed to higher temperatures than in those using a liquid fuel, with no combustion products accumulated on sliding surfaces of valves, so that their sliding portions undergo metal contact, resulting in drastically increased wear.

JP 11-12697 A discloses a sintered alloy for valve seats capable of keeping excellent wear resistance and low attackability to mating members, even under conditions of easily causing metal contact between valve seats and valves, like when used in gas fuel engines, the sintered alloy comprising as matrix components at least 0.5-1.5% of C, and 0.5-10% of Cr and/or V, the balance being Fe, and containing 26-50% by weight of hard cobalt-based particles. Also, JP 2002-285293 A discloses a sintered alloy for valve seats exhibiting excellent high-temperature wear resistance in high-load engines such as CNG engines, heavy-duty diesel engines, etc., the sintered alloy having a composition comprising by mass 12.7-35.3% of Co, 5.4-16.2% of Mo, 1.8-6% of Cr, 0.02-0.24% of V, 0.4-1.5% of Si, 0.6-1.2% of C, and 0.01-1.8% of Ni, the balance being Fe and inevitable impurities, and a metal structure in which hard phases mainly composed of Mo silicide surrounded by Co diffusion phases are dispersed in bainite with or without sorbite. Further, JP 2006-299404 A discloses a sintered iron-based alloy usable for valve seats for gas fuel engines, which has a matrix composition comprising by mass 0.3-1.5% of C, and 1-20% in total of one or more selected from the group consisting of Ni, Co, Mo, Cr and V, the balance being Fe and inevitable impurities; and contains one or more intermetallic compounds comprising Fe, Mo and Si as main components, and intermetallic compounds comprising Ni, Mo and Si as main components, as hard particles; the sintered iron-based alloy containing 10-60% by mass of hard particles having Vickers hardness Hv0.1 of 500-1200, and having a density of 6.7 g/cm$^3$ or more and radial crushing strength of 350 MPa or more.

Any of the sintered alloys disclosed in JP 11-12697 A, JP 2002-285293 A and JP 2006-299404 A has improved wear resistance and heat resistance by containing Co in a matrix and/or hard particles. However, because Co hinders the formation of a dense oxide film having excellent adhesion, an oxide film is hardly formed on the sliding surface particularly at as low temperatures as 250° C. or lower, resulting in insufficient wear resistance.

As a Co-free, sintered iron-based alloy, JP 4299042 B discloses a sintered iron-based alloy containing 3-20% by mass of hard particles dispersed in a matrix comprising by mass 3-12% of Ni, 3-12% of Mo, 0.1-3% of Nb, 0.5-5% of Cr, 0.6-4% of V, and 0.5-2% of C, the balance being Fe and inevitable impurities; the matrix comprising an iron matrix in which Ni, Mo, Cr, Nb and V are dissolved, and carbides of Mo, Cr, V and Nb and/or two or more intermetallic compounds of Mo, Cr, V and Nb as dispersed particles. It teaches third hard particles comprising 60-70% of Mo, and 0.1% or less of C, the balance being Fe, as Co-free hard particles. It teaches that a valve seat formed by this sintered iron-based alloy is suitable for gas engines subjected to larger mechanical and thermal load at high temperatures, particularly because both of fine Nb carbide and Nb dissolved in the prealloy increase high-temperature strength without a secondary treatment such as copper infiltration.

Pointing out that the third hard particles of JP 4299042 B comprising 60-70% of Mo, and 0.1% or less of C, the balance being Fe, do not have enough adhesion to the matrix, JP 4368245 B teaches that the adhesion is improved by hard particles comprising 60-70% of Mo, 0.3-1.0% of B, and 0.1% or less of C, the balance being Fe and inevitable impurities.

Though the Co-free, sintered iron-based alloys having excellent high-temperature strength, which are disclosed in JP 4299042 B and JP 4368245 B, are free of a problem that a dense oxide film having good adhesion cannot be formed, an oxide film is not sufficiently formed at low temperatures of 250° C. or lower, leaving room for improvement in the wear resistance of valve seats for gas engines.

Because a sliding surface of a valve seat coming into contact with a valve is machined when assembled in an engine head, good machinability is indispensable, so that the valve seat should have higher machinability.

OBJECT OF THE INVENTION

In view of the above problems, an object of the present invention is to provide a valve seat of a sintered iron-based alloy having excellent heat resistance, oxidation resistance and wear resistance, as well as excellent machinability without containing Co, which can be used for internal combustion engines using a gas fuel.

DISCLOSURE OF THE INVENTION

As a result of intensive research, the inventors have found that the use of a prealloy containing 12% or more by mass of Cr in a matrix provides an oxidation-resistant passive film of Cr having excellent adhesion predominantly formed on the surface; and that the dispersion of hard particles having high strength and hardness at high temperatures in a sintered iron-based alloy can provide a valve seat exhibiting excellent wear resistance from low temperatures to high temperatures.

Thus, the valve seat of a sintered iron-based alloy according to the present invention has hard particles dispersed in a matrix phase, the valve seat having as a whole a composition comprising by mass 5.0-20.0% of Cr, 0.4-2.0% of Si, 2.0-6.0% of Ni, 5.0-25.0% of Mo, 0.1-5.0% of W, 0.5-5.0% of V, 1.0% or less of Nb, and 0.5-1.5% of C, the balance being Fe and inevitable impurities.

EFFECTS OF THE INVENTION

Because the valve seat of a sintered iron-based alloy according to the present invention is made of a prealloy containing 12% or more by mass of Cr in a matrix, it is provided with a passive film of Cr formed to avoid wear by metal contact, thereby exhibiting excellent wear resistance. Fine secondary carbide particles formed by part of Cr, Mo, W, V and Nb dissolved in a matrix contribute to improving wear resistance and high-temperature strength. Also, by dispersing hard particles having high strength and hardness at high temperatures, such as Fe—Mo—Si alloy particles, it exhibits excellent wear resistance without containing Co up to high temperatures. Further, the dispersion of MnS, a machinability-improving material, improves machinability without deteriorating heat resistance, oxidation resistance and wear resistance. Thus, the valve seat of a sintered iron-based alloy according to the present invention can be advantageously used for internal combustion engines using a gas fuel.

DESCRIPTION OF THE PREFERRED EMBODIMENTS

Figure 1:
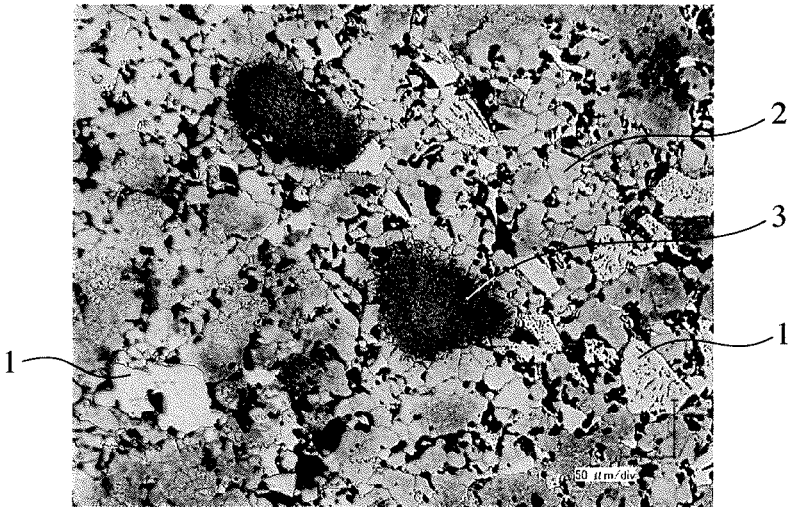
FIG. 1 is a photograph showing the structure of a cross section of the sintered body of Example 1.

The valve seat of a sintered iron-based alloy according to the present invention comprises a matrix formed by a prealloy containing 12% or more by mass of Cr, and hard particles having high strength and hardness at high temperatures. The entire composition of the valve seat comprises by mass 5.0-20.0% of Cr, 0.4-2.0% of Si, 2.0-6.0% of Ni, 5.0-25.0% of Mo, 0.1-5.0% of W, 0.5-5% of V, 0.1-1.0% of Nb, and 0.5-1.5% of C, the balance being Fe and inevitable impurities. The hard particles dispersed in the matrix preferably have hardness HV0.1 of 800-1200 at room temperature, to keep high strength and hardness even at high temperatures. The hard particles are preferably Fe—Mo—Si alloy particles comprising by mass 40.0-70.0% of Mo, 0.4-2.0% of Si, and 0.1% or less of C, the balance being Fe and inevitable impurities. Thus, the hard particles are preferably not reactive with the matrix, or part of alloy elements are preferably not well diffused in the matrix, to suppress the deterioration of their strength and hardness. A sliding surface of the valve seat preferably has a Cr oxide film.

The matrix preferably has a martensite or sorbite phase after quenching and tempering, more preferably contains secondary carbides of one or more of Cr, Mo, W, V, Nb and Fe. The secondary carbides preferably have an average particle size of less than 2 μm. With the dissolution of Cr, Si, Ni, Mo, W, V, Nb in Fe, and the precipitation and dispersion of secondary carbides, the sintered iron-based alloy has improved heat resistance, oxidation resistance and wear resistance.

In the present invention, MnS particles can be added as a machinability-improving material. MnS particles are dispersed preferably in an amount of 0.5-3% by mass. Machinability-improving materials (solid lubricants) such as $CaF_2$ and BN, which act like voids, are undesirable because they decrease the strength of the valve seat.

The sintered iron-based alloy for the valve seat of the present invention has a composition comprising by mass 5.0-20.0% of Cr, 0.4-2.0% of Si, 2.0-6.0% of Ni, 5.0-25.0% of Mo, 0.1-5.0% of W, 0.5-5% of V, 1.0% or less of Nb, and 0.5-1.5% of C, the balance being Fe and inevitable impurities. Particularly, Cr is dissolved in the matrix or forms carbide to strengthen the matrix, and combined with oxygen in the air to form a passive film of hydrated Cr oxide on the surface, largely contributing to improving the oxidation resistance. Taking into consideration balance with Ni, an austenite-stabilizing element, and Mo, W, V and Nb, carbide-forming elements, in the present invention, the Cr content is 5.0-20.0%, preferably 7-18.0%, more preferably 8.0-16.0%, in a range of forming a passive film without precipitating a σ phase.

Si is important for Cr to form a passive film. Though the formation of a Cr-based oxide film generally needs about 18% or more by mass of Cr, in the valve seat of the present invention, even Cr in an amount of about 5.0% is concentrated on the surface with 0.4% or more of Si added, so that a Cr oxide film is formed on the surface. Si also forms $Fe_2SiO_4$ as a primary layer, contributing to improving the adhesion of an Fe oxide ($Fe_2O_3$) film to the surface. However, when the Si content exceeds 2.0%, the primary layer becomes too thick, undesirably decreasing the adhesion. Accordingly, the Si content is 0.4-2.0%, preferably 0.6-1.8%, more preferably 0.8-1.6%. In the present invention, the Cr oxide film does not have to cover the entire surface, but Fe oxide or oxide of Fe and Si may be formed to achieve an object of avoiding metal contact. Of course, an oxide film on the surface is preferably constituted mainly by the Cr oxide film.

Ni has effects of strengthening the matrix and improving the wear resistance. To have good balance of wear resistance with thermal expansion due to increased austenite, the Ni content is 2.0-6.0%, preferably 2.5-5.5%, more preferably 3.0-5.0%, in the present invention.

Mo, W, V and Nb form carbides and intermetallic compounds, improving hardness and wear resistance, particularly strength and hardness at high temperatures. In the present invention, the Mo content is 5.0-25.0%, preferably 10.0-20.0%, more preferably 12.0-18.0%. The W content is 0.1-5.0%, preferably 0.3-4.0%, more preferably 0.5-3.0%. The V content is 0.5-5%, preferably 0.5-4%, more preferably 1-3%. The Nb content is 1.0% or less, preferably 0.3-0.9%, more preferably 0.4-0.8%.

C is generally dissolved in the matrix to strengthen it, and forms carbides with other alloy elements to improve the wear resistance. When C is less than 0.5%, ferrite is formed in the present invention, failing to obtain desired hardness, and thus resulting in poor wear resistance. On the other hand, when C exceeds 1.5%, martensite and various carbides are excessively formed, resulting in poor toughness and wear resistance. Accordingly, the C content is 5-1.5%, preferably 0.6-1.4%, more preferably 0.7-1.3%.

To have excellent wear resistance, the matrix is preferably quenched and tempered after sintering, to contain a tempered martensite phase or a sorbite phase. The tempered martensite phase is selected for hardness, while the sorbite phase is selected for toughness. By tempering, fine secondary carbide particles of one or more of Cr, Mo, W, V, Nb and Fe are dispersively precipitated, resulting in high strength and hardness, as well as improved heat resistance. To have high hardness and toughness, the average particle size of secondary carbides is preferably less than 2 μm, more preferably less than 1 μm.

In the production of the valve seat of a sintered iron-based alloy according to the present invention, a raw material for the matrix is preferably, for example, a prealloy powder comprising by mass 12.0-25.0% of Cr, 0.5-4.0% of Mo, 0.5-5.0% of W, 0.5-5% of V, 0.4-2.0% of Si, and 2.0% or less of C, the balance being Fe and inevitable impurities. In addition to the above prealloy powder, for example, a prealloy powder comprising by mass 0.5-2.0% of Cr, 0.5-4.0% of Mo, 0.5-5% of V, 0.2-1.0% of Nb, 2.0% or less of Si, and 0.8% or less of C, the balance being Fe and inevitable impurities, is preferably used. Added to such prealloy powder are alloy element powders (carbonyl nickel powder or molybdenum powder), ferroalloy powders, graphite powder, etc. The prealloy powder and the alloy element powders are blended with hard particles to provide mixed a raw material powder. 0.5-2% of stearate, etc. as a parting agent may be added to the total amount of the mixed raw material powder (prealloy powder+alloy element powder+hard particles).

The mixed powder is preferably compression-molded to a green compact by a press, etc., sintered at 1100-1200° C. in vacuum or in a non-oxidizing (or reducing) atmosphere, and tempered at 500-700° C. The non-oxidizing (or reducing) atmosphere is desirably a mixed gas of $NH_3$, $N_2$, $H_2$, etc.

Example 1

The first prealloy powder comprising by mass 16.0% of Cr, 1.5% of Mo, 1.5% of W, 1.0% of V, 0.5% of Si, and 1.5% of C, the balance being Fe, and a second prealloy powder comprising by mass 1.0% of Cr, 2.0% of Mo, 3% of V, 0.5% of Nb, 1.1% of Si, and 0.4% of C, the balance being Fe, were mixed at a ratio (first prealloy powder/second prealloy powder) of 9/1. The mixed prealloy powders were blended in a blender with carbonyl nickel powder and molybdenum powder in amounts corresponding to 4.0% by mass of Ni and 3.0% by mass of Mo, and as hard particles 20% by mass of Fe—Mo—Si alloy powder comprising by mass 60.9% of Mo, 1.2% of Si, and 0.05% of C, the balance being Fe and inevitable impurities, to prepare a mixed raw material powder. To improve parting properties in a molding step, 0.5% of zinc stearate was added to the mixed raw material powder.

The mixed powder was charged into a press-molding die, compression-molded at 600 MPa, and sintered at a temperature of 1180° C. in vacuum in a furnace, to produce a ring-shaped sintered body having an outer diameter of 37.6 mm, an inner diameter of 26 mm and a thickness of 8 mm. The sintered body had a density of 6.71 g/cm$^3$, and hardness HRB of 95.5. Chemical analysis revealed that the entire valve seat had a composition comprising 11.4% of Cr, 0.7% of Si, 4.2% of Ni, 16.1% of Mo, 1.0% of W, 0.98% of V, 0.05% of Nb, and 1.11% of C, the balance being Fe.

In a photograph of FIG. 1 showing the structure of a cross section of the sintered body of Example 1, first prealloy phases 2 (bright white) having a similar tone to the hard particles 1 (bright white), and second prealloy phases 3 (dark color) were observed, with the first prealloy phases 2 as a main phase. It was observed that fine secondary carbide particles were precipitated in the first prealloy phases 2 and the second prealloy phases 3.

Example 2

A ring-shaped sintered body was produced in the same manner as in Example 1, except for using only the first prealloy powder as the prealloy powder. The sintered body had a density of 6.70 g/cm$^3$ and hardness HRB of 96.9. Chemical analysis revealed that it comprised 12.9% of Cr, 0.7% of Si, 4.1% of Ni, 16.6% of Mo, 1.2% of W, 0.93% of V, and 1.23% of C, the balance being Fe.

Example 3

A ring-shaped sintered body was produced in the same manner as in Example 1, except that the first prealloy powder and the second prealloy powder were mixed at a ratio of 4/6. The sintered body had a density of 6.79 g/cm$^3$ and hardness HRB of 98.0. Chemical analysis revealed that it comprised 5.6% of Cr, 0.9% of Si, 3.9% of Ni, 16.1% of Mo, 0.5% of W, 1.78% of V, 0.26% of Nb, and 0.71% of C, the balance being Fe.

Figure 2:
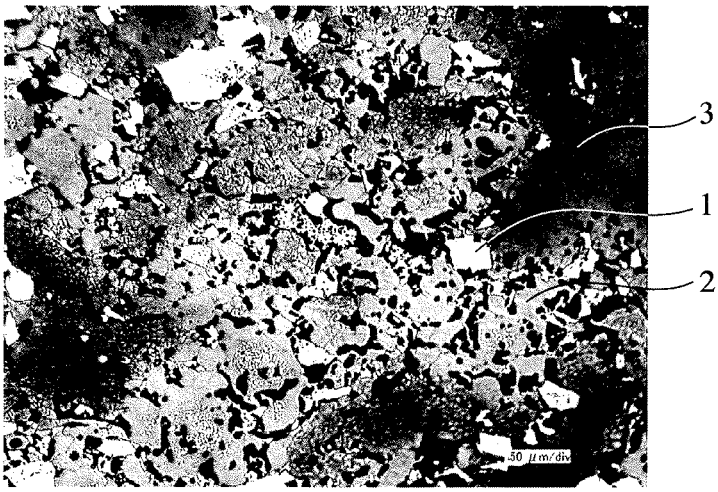
FIG. 2 is a photograph showing the structure of a cross section of the sintered body of Example 3.

In a photograph of FIG. 2 showing the structure of a cross section of the sintered body of Example 3, hard particles 1 (bright white) were more clearly identified than in the structure photograph of Example 1, presumably because the second prealloy phases 3 (dark color) spread in larger areas. It was also observed that alloy elements (particularly Cr) were diffused between the first and second prealloys, with secondary carbides precipitated.

Comparative Example 1

A ring-shaped sintered body was produced in the same manner as in Example 1, except for using only the second prealloy powder as the prealloy powder, and Co—Mo—Cr—Si alloy particles comprising by mass 28.0% of Mo, 9.0% of Cr, and 2.5% of Si, the balance being Co and inevitable impurities, as hard particles. The sintered body had a density of 7.29 g/cm$^3$ and hardness HRB of 97.7. Chemical analysis revealed that it comprised 12.6% of Co, 2.3% of Cr, 1.4% of Si, 4.2% of Ni, 6.9% of Mo, 2.30% of V, 0.35% of Nb, and 0.39% of C, the balance being Fe.

Comparative Example 2

A ring-shaped sintered body was produced in the same manner as in Example 1, except that only the second prealloy powder was used as the prealloy powder, and that 0.5% by mass of graphite powder was added. The sintered body had a density of 6.86 g/cm$^3$ and hardness HRB of 90.5. Chemical analysis revealed that it comprised 0.8% of Cr, 1.2% of Si, 4.1% of Ni, 17.3% of Mo, 2.56% of V, and 0.91% of C, the balance being Fe.

Example 4

A ring-shaped sintered body was produced in the same manner as in Example 1, except that 1.0% by mass of MnS was further added to the raw material powder of Example 1. The sintered body had a density of 6.75 g/cm$^3$ and hardness HRB of 94.9. Chemical analysis revealed that it comprised 10.8% of Cr, 0.7% of Si, 3.9% of Ni, 15.9% of Mo, 0.9% of W, 0.95% of V, 1.07% of C, 0.81% of Mn, and 0.38% of S, the balance being Fe.

The chemical compositions of the entire sintered valve seats of Examples 1-4 and Comparative Examples 1 and 2 are shown in Table 1, and the types of hard particles, the sintering density and hardness of each sintered valve seat are shown in Table 2.

TABLE 1

| No. | Chemical Composition of Entire Valve Seat (% by mass) | | | | | | | | | | | |
|---|---|---|---|---|---|---|---|---|---|---|---|---|
| | Cr | Mo | W | V | Nb | Si | C | Ni | Co | Mn | S | Fe |
| Example 1 | 11.4 | 16.1 | 1.0 | 0.98 | 0.05 | 0.7 | 1.11 | 4.2 | — | — | — | Bal. |
| Example 2 | 12.9 | 16.6 | 1.2 | 0.93 | — | 0.7 | 1.23 | 4.1 | — | — | — | Bal. |
| Example 3 | 5.6 | 16.1 | 0.5 | 1.78 | 0.26 | 0.9 | 0.71 | 3.9 | — | — | — | Bal. |
| Com. Ex. 1 | 2.3 | 6.9 | — | 2.30 | 0.35 | 1.4 | 0.39 | 4.2 | 12.6 | — | — | Bal. |
| Com. Ex. 2 | 0.8 | 17.3 | — | 2.56 | — | 1.2 | 0.91 | 4.1 | — | — | — | Bal. |
| Example 4 | 10.8 | 15.9 | 0.9 | 0.95 | — | 0.7 | 1.07 | 3.9 | — | 0.81 | 0.38 | Bal. |

TABLE 2

| No. | Type of Hard Particles | Sintering Density ($g/cm^3$) | Hardness HRB |
|---|---|---|---|
| Example 1 | Fe—Mo—Si Alloy Powder | 6.71 | 95.5 |
| Example 2 | Fe—Mo—Si Alloy Powder | 6.70 | 96.9 |
| Example 3 | Fe—Mo—Si Alloy Powder | 6.79 | 98.0 |
| Com. Ex. 1 | Co—Mo—Cr—Si Alloy Powder | 7.29 | 97.7 |
| Com. Ex. 2 | Fe—Mo—Si Alloy Powder | 6.86 | 90.5 |
| Example 4 | Fe—Mo—Si Alloy Powder | 6.75 | 94.9 |

[1] Wear Test

Figure 3:
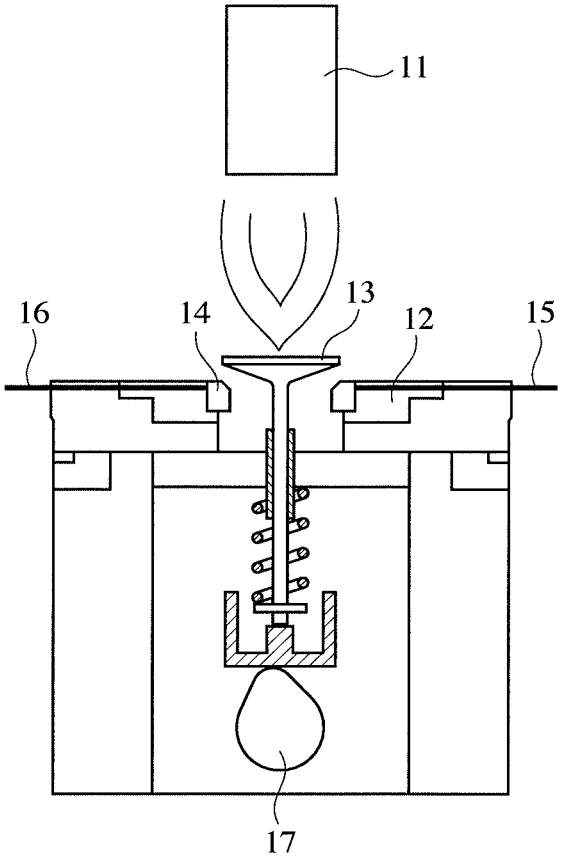
FIG. 3 is a schematic view showing a single wear test for evaluating the wear resistance of a valve seat.

Each ring-shaped sintered body of Examples 1-4 and Comparative Examples 1 and 2 was formed into a valve seat, and its wear resistance was evaluated by a single wear test machine shown in FIG. 3. The valve seat 14 was pressed into a valve seat holder 12 made of the same material as that of a cylinder head, and set in the test machine to conduct a wear test by moving a valve 13 up and down by the rotation of a cam 17, while heating the valve 13 and the valve seat 14 by a burner 11. With thermocouples 15, 16 embedded in the valve seat 14, the power of the burner 11 was adjusted to heat a sliding surface of the valve seat to a predetermined temperature. The valve seat 14 was worn by repeated impinging of the valve 13, and its amount of wear was expressed by the receding distance of the sliding surface determined by measuring the shapes of the valve seat and the valve before and after the test. The valve used was formed by build-up welding a Co alloy (Co-29% Cr-8% W-1.35% C-3% Fe) on a substrate to a size adapted to the above valve seat. The test conditions were that the sliding surface of the valve seat was at temperatures of 250° C., 350° C. and 450° C., respectively, that the cam was rotated at 2000 rpm, and that the test time was 5 hours. The test results are shown in Table 3, by relative values assuming that the wear of the valve seat of Comparative Example 1 at 250° C. was 1.

TABLE 3

| No. | Wear of Valve Seat | | | Wear of Valve | | |
|---|---|---|---|---|---|---|
| | 250° C. | 350° C. | 450° C. | 250° C. | 350° C. | 450° C. |
| Example 1 | 0.22 | 0.19 | 0.18 | 0.18 | 0.03 | 0.03 |
| Example 2 | 0.20 | 0.17 | 0.16 | 0.15 | 0.02 | 0.02 |
| Example 3 | 0.36 | 0.22 | 0.23 | 0.15 | 0.08 | 0.07 |
| Com. Ex. 1 | 1 | 0.21 | 0.20 | 0.08 | 0.06 | 0.07 |
| Com. Ex. 2 | 0.49 | 0.32 | 0.34 | 0.16 | 0.09 | 0.14 |
| Example 4 | 0.23 | 0.18 | 0.18 | 0.16 | 0.02 | 0.03 |

The wear of the valve seat at a temperature of 250° C. was smaller in Examples 1-4 than in Comparative Example 1 by as much as 64-80%, and than in Comparative Example 2 sufficiently by 27-59%. Even at high temperatures of 350° C. and 450° C., wear resistance in Examples 1-4 was equal to or higher than in Comparative Example 1, though not containing Co. The wear of the valve was also sufficiently low in Examples 1-4, on the same level as in Comparative Examples 1 and 2.

[2] Machinability Test

The machinability of the sintered bodies of Examples 1-4 and Comparative Examples 1 and 2 was measured by a so-called traverse cutting test using a commercially available lathe comprising CBN chips as cutting tools, at a cutting speed of 100 m/min, a cutting depth of 0.1 mm, and a feed speed of 0.1 mm/rev, without using a cutting liquid (dry cutting). The machinability was expressed by the maximum wear of the tool when a predetermined number of valve seats were cut. The results are shown in Table 4, by relative values assuming that the maximum wear of the cutting tool of Comparative Example 1 was 1.

TABLE 4

| No. | Maximum Wear of Cutting Tool |
|---|---|
| Example 1 | 0.95 |
| Example 2 | 0.96 |
| Example 3 | 0.94 |
| Com. Ex. 1 | 1 |
| Com. Ex. 2 | 0.93 |
| Example 4 | 0.83 |

The machinability in Examples 1-3 was on the same level as in Comparative Example 2, though Example 3 containing MnS as a machinability-improving material exhibited the highest machinability.

What is claimed is:

1. A valve seat of a sintered iron-based alloy having hard particles dispersed in a matrix, said valve seat having a composition comprising as a whole by mass 5.0-20.0% of Cr,
0.4-2.0% of Si,
2.0-6.0% of Ni,
10.0-25.0% of Mo,
0.1-5.0% of W,
0.5-5.0% of V,
1.0% or less of Nb, and
0.5-1.5% of C,
the balance being Fe and inevitable impurities.

2. The valve seat of a sintered iron-based alloy according to claim 1, wherein said hard particles are Fe—Mo—Si alloy particles comprising by mass 40.0-70.0% of Mo, 0.4-2.0% of Si, and 0.1% or less of C, the balance being Fe and inevitable impurities.

3. The valve seat of a sintered iron-based alloy according to claim 1, whose sliding surface has a passive film of hydrated Cr oxide.

4. The valve seat of a sintered iron-based alloy according to claim 1, wherein said matrix comprises a martensite or sorbite phase.

5. The valve seat of a sintered iron-based alloy according to claim 1, wherein said matrix contains secondary carbides of one or more of Cr, Mo, W, V, Nb and Fe.

6. The valve seat of a sintered iron-based alloy according to claim 1, in which 0.5-3% by mass of MnS particles are dispersed.

7. A method for producing the valve seat of a sintered iron-based alloy according to claim 1, comprising providing a first prealloy powder comprising by mass 12.0-25.0% of Cr, 0.5-4.0% of Mo, 0.5-5.0% of W, 0.5-5% of V, 0.4-2.0% of Si, and 2.0% or less of C, the balance being Fe and inevitable impurities, adding alloy element powders comprising carbonyl nickel powder, molybdenum powder, ferroalloy powders, graphite powders, or mixtures thereof, and hard particles to said first prealloy powder to form a mixed raw material powder, compression-molding said mixed raw material powder to form a green compact body, sintering said green compact body, and tempering the sintered body.

8. The method for producing a valve seat of a sintered iron-based alloy according to claim 7, wherein said mixed raw material powder further comprises a second prealloy powder comprising by mass 0.5-2.0% of Cr, 0.5-4.0% of Mo, 0.5-5% of V, 0.2-1.0% of Nb, 2.0% or less of Si, and 0.8% or less of C, the balance being Fe and inevitable impurities.

9. The method for producing a valve seat of a sintered iron-based alloy according to claim 7, wherein said mixed raw material powder comprises as said hard particles 10-30% by mass of Fe—Mo—Si alloy particles comprising by mass 40.0-70.0% of Mo, 0.4-2.0% of Si, and 0.1% or less of C, the balance being Fe and inevitable impurities.

10. The method for producing a valve seat of a sintered iron-based alloy according to claim 7, wherein said green compact body of the raw material powder is sintered at a temperature of 1100-1200° C. in a non-oxidizing atmosphere, and the sintered body is tempered at a temperature of 500-700° C. in a non-oxidizing atmosphere.

* * * * *